US006003724A

United States Patent [19]

Collins et al.

[11] Patent Number: 6,003,724

[45] **Date of Patent: *Dec. 21, 1999**

[54] APPARATUS FOR SECURING A CUP DISPENSING COLLAR TO A CUP DISPENSER

[75] Inventors: Scott J. Collins, Brown Deer; James R. Walsh, Wauwatosa, both of Wis.

[73] Assignee: The Colman Group, Inc., Elkhorn, Wis.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/922,085

[22] Filed: Sep. 2, 1997

Related U.S. Application Data

[63] Continuation-in-part of application No. 08/644,253, May 10, 1996, Pat. No. 5,709,316.

[51] Int. Cl.[6] ..... A47F 1/04

[52] U.S. Cl. ..... 221/154; 221/221; 221/304; 221/310; 403/349

[58] Field of Search ..... 221/154, 221, 221/223, 307, 308, 310, 304; 403/348, 349, 350

[56] References Cited

U.S. PATENT DOCUMENTS

| | | | |
|---|---|---|---|
| 3,211,329 | 10/1965 | Boyd | 221/279 |
| 3,851,601 | 12/1974 | Davis | 403/349 |
| 4,158,983 | 6/1979 | Amico | 403/349 |
| 4,176,815 | 12/1979 | Davidson et al. | 403/349 |
| 5,199,601 | 4/1993 | Roethal | 221/310 |
| 5,709,316 | 1/1998 | Jolly et al. | 221/304 |

*Primary Examiner*—William E. Terrell
*Assistant Examiner*—Patrick Mackey
*Attorney, Agent, or Firm*—Michael Best & Friedrich LLP

[57] ABSTRACT

A cup dispenser includes a housing for storing a plurality of cups nested in a stack. The cup dispenser has an annular collar surrounding the exterior of the housing. An annular retaining ring carries a cup holding member that is removably mounted on the collar such that the cup holding member is disposed over the discharge end of the housing to control removal of cups from the stack. The collar and housing have a locking arrangement which cooperates to permit relative movement of the collar and housing between a locked position and an unlocked position where the collar and housing can be separated. Portions of the collar and locking arrangement exposed to the interior of the housing preferably are substantially free of crevices or cavities which can trap bacteria.

14 Claims, 5 Drawing Sheets

APPARATUS FOR SECURING A CUP DISPENSING COLLAR TO A CUP DISPENSER

RELATED APPLICATIONS

This patent application is a continuation-in-part of co-pending application Ser. No. 08/644,253 filed May 10, 1996 and issued as U.S. Pat. No. 5,709,316 on Jan. 20, 1998.

BACKGROUND OF THE INVENTION

The invention relates to cup dispensers and, more particularly, to dispensers for dispensing beverage cups and the like.

In some commercial establishments, particularly fast food establishments and convenience stores, paper or foam cups typically are dispensed from dispensers including a tubular housing containing a stack of cups and mounted on a wall, supported on some kind of base resting on a counter or mounted beneath a counter. The housing of a wall-mounted dispenser usually is mounted in vertical position. The housing for base-supported dispensers is vertical, horizontal or at an acute angle. In both cases, the rim of the outer most cup in the stack is supported on or restrained by a flexible retainer, such as ledges, tabs or some kind of diaphragm, located in the lower or outer end of the housing. By pulling on the outermost cup, the rim of the cup can pass over the retainer and be withdrawn from the housing.

With counter-mounted dispensers, the housing is located beneath the counter with the upper end accessible from above the counter top. This stack of cups is urged upwardly within the housing by a spring and the rim of the uppermost cup is supported beneath a flexible retainer located adjacent to the upper end of the housing. As a cup is withdrawn from the housing, the spring force urges the stack upwardly to a location where the next cup can be withdrawn.

One type cup dispenser includes a collar or mounting ring surrounding the discharge end of the housing for removably receiving a trim or retaining ring carrying a diaphragm or other cup restraining means. This collar or mounting ring typically is a separate part permanently affixed to the housing by some kind of fastener, particularly when the housing is formed from a synthetic thermoplastic material. Some fasteners, such as rivets, can create crevices and/or other cavities in which bacteria can be trapped. To qualify for certification by the National Sanitary Foundation, cup dispensers cannot include such crevices or small cavities.

SUMMARY OF THE INVENTION

An object of the invention is to provide a cup dispenser including a housing and a collar or mounting ring surrounding the discharge end of the housing which does not include crevices and/or small cavities susceptible to trapping bacteria.

Another object of the invention is to provide such a cup dispenser including a removably mounted collar or mounting ring and arranged to positively lock the collar or mounting ring on the housing.

A further object of the invention is to provide such a cup dispenser including a cylindrical housing and means for insuring that, in the event the discharge end of the housing is out of its normally round shape, it is returned to its normal shape upon assembly with the collar or mounting ring.

The invention provides a cup dispenser including an elongated tubular housing for storing a plurality of cups nested in a stack, an annular collar surrounding an exterior surface of the housing, a locking arrangement on the collar and the housing cooperating to provide a removable connection therebetween at a location adjacent the discharge end of the housing.

The locking arrangement also cooperates to afford relative movement of the collar and housing between a locked position wherein relative longitudinal and rotational movement of the collar and housing are restrained and an unlocked position wherein relative movement of the collar and housing is permitted to separate one from the other. An annular retaining ring carrying a cup holding member is removably mounted on the collar such that the cup holding member is disposed over the discharge end of the housing to control removal of cups from the stack. Portions of the inner surface of the collar and the locking arrangement exposed to the interior of the housing and the interior surface of the housing in the vicinity of the discharge end are substantially free from crevices or cavities which can trap bacteria.

In one embodiment, the locking arrangement includes a plurality of circumferentially spaced, generally J-shaped slots extending from the top or outer edge of the housing, each of which is arranged to receive a radially inwardly projecting lug on the collar and each of which cooperates with the outer edge of the housing to define a tab-like portion which is flexed in a direction toward the top edge of the housing from its normal position to a flexed position during relative movement of the housing and the collar between locked and unlocked positions. The collar includes a circumferentially extending ledge which projects radially inwardly from the inner surface of the collar, extends over the outer edge of the housing and has recesses in the vicinity of the tab-like housing portions for accommodating movement of the tab-like portion to the flexed position.

In another embodiment, the housing normally has a circular cross sectional or round shape and the collar includes a plurality of circumferentially, radially inwardly projecting guide members which are arranged to engage the discharge end of the housing, when it does not have its normal shape, and move it back to its normal round shape during assembly of the collar and housing.

DETAILED DESCRIPTION

While the invention can be adapted for wall-mounted and base-supported dispensers used for dispensing a wide variety of different size and types of cups, it is particularly adaptable for counter-mounted dispensers for dispensing hot or cold paper or foam cups for beverages and will be described in connection with that application.

Figure 3:
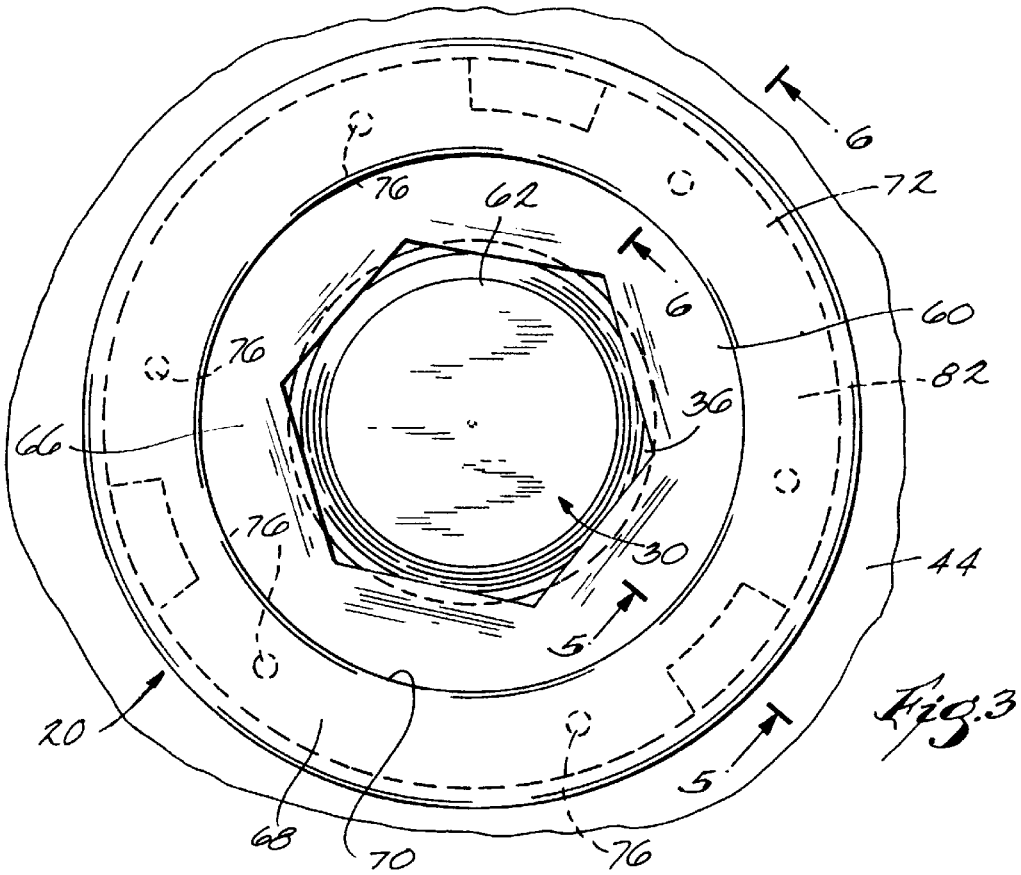
FIG. 3 is a top plan view of the cup dispenser illustrated in FIG. 1, shown assembled and with cups in place for dispensing.
Figure 1:
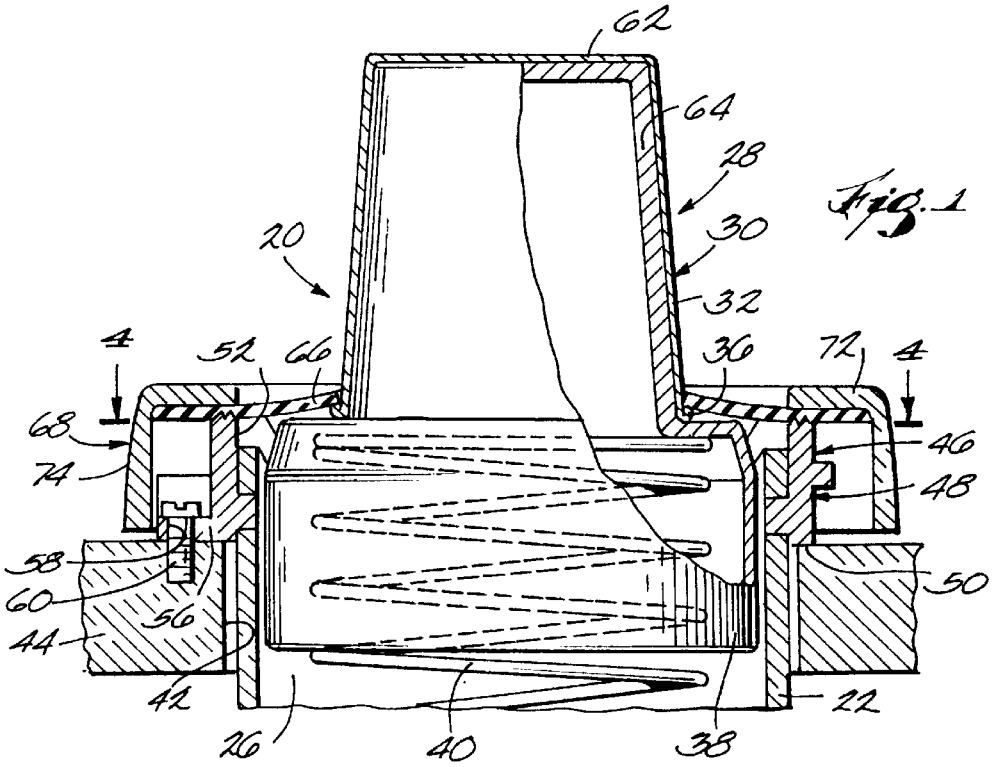
FIG. 1 is a fragmentary, partially broken away and partially cross sectional view of a counter-mounted cup dispenser embodying various features of the invention.
Figure 2:
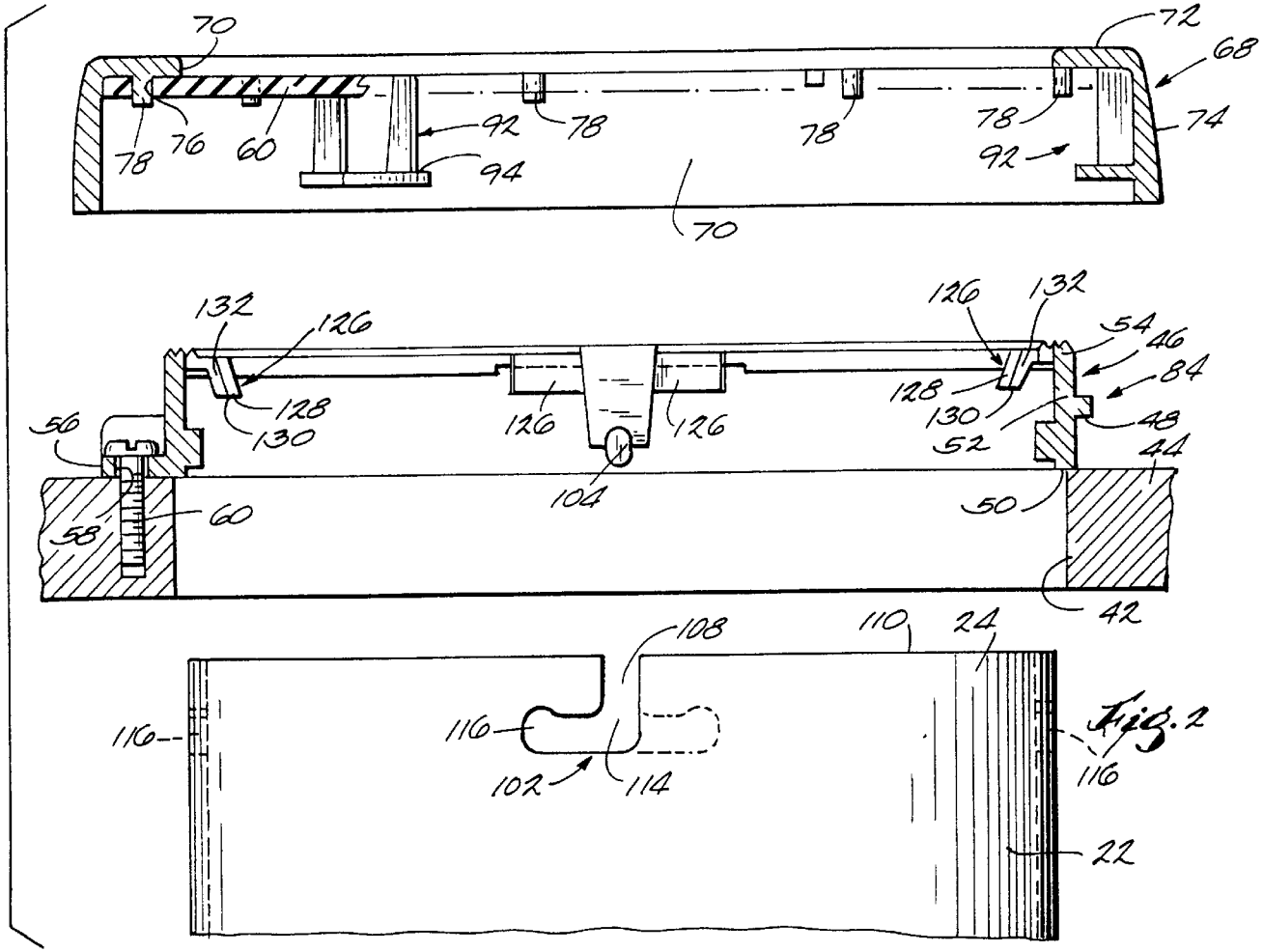
FIG. 2 is an exploded, enlarged and partially cross sectional view of the cup dispenser illustrated in FIG. 1, shown without cups.

The drawings illustrate a counter-mounted cup dispenser 20 embodying the invention. Referring to FIGS. 1–3, the dispenser 20 includes an elongated, tubular and generally cylindrical housing 22 having an end cap (not shown), an upper or discharge end 24 and a chamber 26 for holding an inverted stack 28 of nested, foam or paper beverage cups 30 (one shown). Each cup 30 has a tapered or frusto-conical side wall 32, a bottom wall 34 and an open top surrounded by a radially outwardly extending rim 36. The stack 28 of cups 30 rests on a platform 38 which is urged upwardly toward the discharge end 24 of the housing 22 by a spring 40 disposed between the end cap of the housing 22 and the platform 38. The upper portion of the housing 22 extends through an aperture 42 in a counter top 44.

Figure 5:
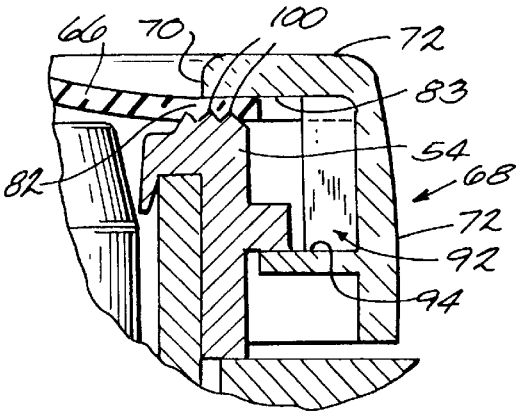
FIG. 5 is an enlarged, fragmentary, cross sectional view taken generally along line 5—5 in FIG. 3.
Figure 6:
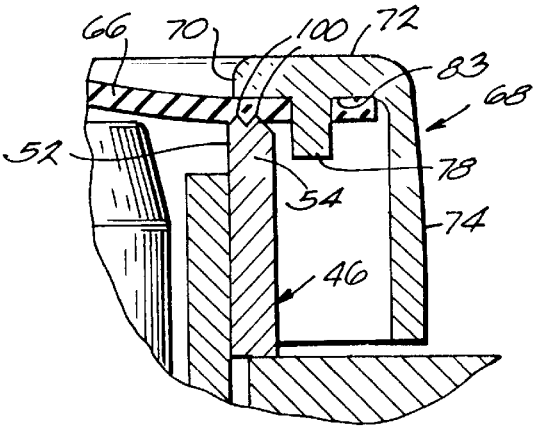
FIG. 6 is an enlarged, fragmentary, cross sectional view taken generally along line 6—6 in FIG. 3.

The housing 22 is retained in place by a collar or mounting ring 46 including an annular sleeve portion 48 which surrounds the counter top aperture 42 and has a bottom edge 50 resting on the counter top 44. The mounting ring 46 has a central opening 52 generally coaxial with the discharge end 24 of the housing 22 and surrounded by a top rim 54 (FIGS. 5 and 6). The sleeve portion 48 has a plurality (e.g., 3) of circumferentially spaced, radially outwardly extending mounting tabs 56 which rest on the counter top 44. Each mounting tab 56 has an aperture 58 through which a mounting screw 60 extends and is screwed into the counter top 44 to fasten the mounting ring 46 in place. The housing 22 is removably mounted on the mounting ring 46 as described below.

Covering the discharge end 24 of the housing 22 is a flexible diaphragm 60 including a central opening 62 through which the bottom portion of the outermost cup 30 in the stack 28 is urged upwardly by the spring 40 acting on the platform 38. The platform 38 has a centrally located, upwardly extending frusto-conical protuberance 64 over which the lowermost cup 30 fits to generally axially align the stack 28 of cups 30 with the diaphragm opening 62.

The diaphragm 60 is arranged in any suitable manner which permits the outermost cup 30 to be withdrawn or pulled off the stack but retains the next cup on the stack. In the specific embodiment illustrated, the diaphragm opening 62 is configured and dimensioned so that portions of a web section 66 surrounding the opening 62 engage the underside of the rim 36 of the outermost cup 30 as best shown in FIG. 1. This engagement must be releasable in the sense that the outermost cup 30 can be withdrawn or pulled off the stack 28 and yet a sufficient force is applied on the rim and/or body of the next cup 30 to restrain it from being pulled off the stack 28.

The diaphragm 60 can be arranged in the manner described in U.S. Pat. No. 5,709,319, entitled "Cup Dispenser" and filed May 10, 1996, which incorporated herein by reference. This application discloses a diaphragm adapted for use with different size cups. Generally, the diaphragm opening 62 preferably has a symmetrical polygonal shape and includes straight segments which engage the rim and/or body of the cups, preferably a hexagonal shape as illustrated. However, the diaphragm opening 62 can be generally circular or any other shape which provides the desired engagement of the rims of the particular size cups being disposed.

The diaphragm 62 preferably is made from a suitable elastomeric material capable of providing the function described above, such as silicone rubber.

The diaphragm 62 is held in place on the mounting ring 46 by a trim or retaining ring 68 which fits over and is removably connected to the mounting ring 46. The retaining ring 68 has a central opening 70 generally coaxial with the diaphragm opening 62, an annular shoulder 72 extending radially outwardly from the opening 70 and a peripheral flange 74 depending from the shoulder 72. The diaphragm 60 preferably is removably mounted on the retaining ring 68. In the specific construction illustrated, the diaphragm 60 had plurality (e.g., 6) of circumferentially spaced apertures 76 in the outer peripheral portion and spaced radially inwardly from the outer perimeter of the diaphragm 60. The retaining ring 68 has an equal number of posts 78 (FIG. 7) extending axially from the inner surface 80 of the shoulder 72 toward a discharge end 24 of the housing 22. The apertures 76 in the diaphragm 60 fit snugly over the posts 78 so that the diaphragm 60 can be installed on the retaining ring 68 and carried thereby when the retaining ring 68 is fitted over the mounting ring 46 during installation. When the retaining ring 68 is installed, the outer peripheral portion of the diaphragm 60 is disposed between the top rim 54 of the mounting ring 46 and the inner surface 80 of the retaining ring shoulder 72.

The portion of the web section 66 surrounding the diaphragm opening 62 preferably is maintained taut enough to apply a sufficient force on the underside of the rim and/or body of the cups to minimize the possibility of two or more being pulled off a stack at a time. This can be accomplished by positively restraining radially inward movement of the web section 66 when a cup 30 is being withdrawn through a diaphragm opening 62. The posts 78 on the retaining ring 68 serve this purpose in part.

Figure 8:
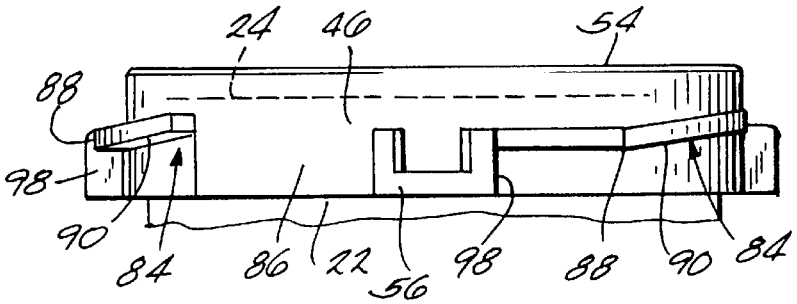
FIG. 8 is a reduced side elevational view of the mounting ring shown mounted on the housing with only the top part of the housing shown.

The retaining ring 68 and the mounting ring 46 preferably include clamping means for sandwiching or squeezing the outer peripheral portion 82 of the diaphragm 60 between the top rim 54 of the mounting ring 46 and the inner surface 80 of the retaining ring 68. In the specific construction illustrated, the mounting ring 46 (FIGS. 4 and 8) includes a plurality of (e.g., 3) of circumferentially spaced ramps 84 projecting radially outwardly from the outer periphery 86 of the mounting ring 46. Each ramp has a generally circumferentially extending ramp guide surface 88 including a portion 90 which slopes in a direction away from the inner surface 80 of the retaining ring 68, i.e., downwardly to the left as viewed in FIG. 8.

Figure 7:
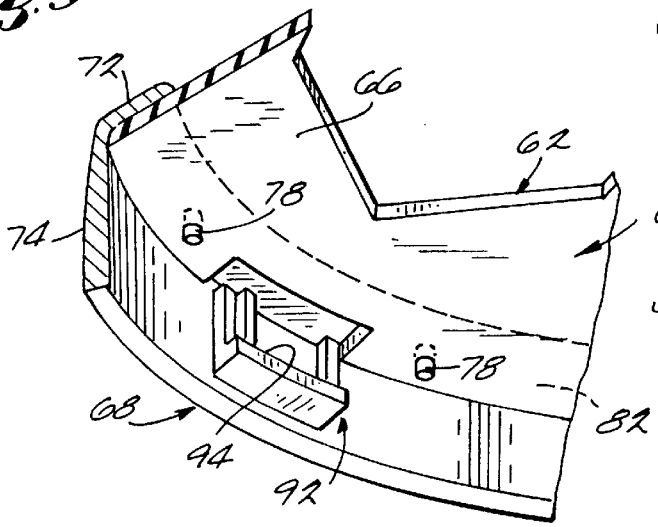
FIG. 7 is an enlarged, fragmentary perspective view of the underside of the retaining ring and diaphragm.

As best shown in FIGS. 5 and 7, the retaining ring 68 has a plurality (e.g., 3) of guide members 92 on the inner periphery of the flange 74 corresponding in number with the ramps 84 on the mounting ring 46. Each guide member 92 has a cam surface 94 which extends beneath and engages a ramp guide surface 88 during rotation of the retaining ring 68 relative to the mounting ring 46 during installation (in a clockwise direction as viewed in FIGS. 5 and 7). As the cam surface 94 rides along the sloped portion 90 of the ramp guide surface 88, the inner surface 80 of the retaining ring shoulder 72 moves axially downward relative to the top rim 54 of the mounting ring 46, causing the outer peripheral portion 82 of the diaphragm 60 to be tightly squeezed therebetween. Rotation of the retaining ring 68 is continued until the leading edges 96 of the guide members 92 (FIG. 7) engage a side 98 (FIG. 8) of the mounting tabs 56.

Either the top rim 54 of the mounting ring 46 or the inner surface 80 of the retaining ring shoulder 72, preferably both, is provided with a plurality of concentric serrations 100 which further restrain radially inward movement of the diaphragm 60 after the retaining ring 68 has been installed as described above.

In accordance with the invention, the housing 22 and the mounting ring 46 are arranged in a manner to eliminate the presence of crevices and/or small cavities in or between the housing 22 and the mounting ring 46 which can trap bacteria. This is accomplished by arranging the mounting ring 46 and the discharge end 24 of the housing 22 so that the mounting ring 46 and the housing 22 are removably connected together and can be locked in position where relative rotational and longitudinal movement is restrained.

In the specific instruction illustrated (FIGS. 9–11), the discharge end 24 of the housing 22 includes a plurality (e.g., 3) of circumferentially spaced, generally J-shaped slots 102 and the mounting ring 46 has a like number of lugs 104 projecting radially outwardly from the inner surface 106 of the sleeve portion 48. Each slot 102 has a first portion or leg 108 extending axially from the outer or top edge 110 of the housing 22 generally parallel to the longitudinal axis 112 of the housing 22, a second portion or leg 114 extending generally perpendicular to the first leg 108 and a shortened third portion or leg 116 extending generally perpendicularly to the second leg 114 in a direction toward the top edge 110 of the housing 22.

Figure 9:
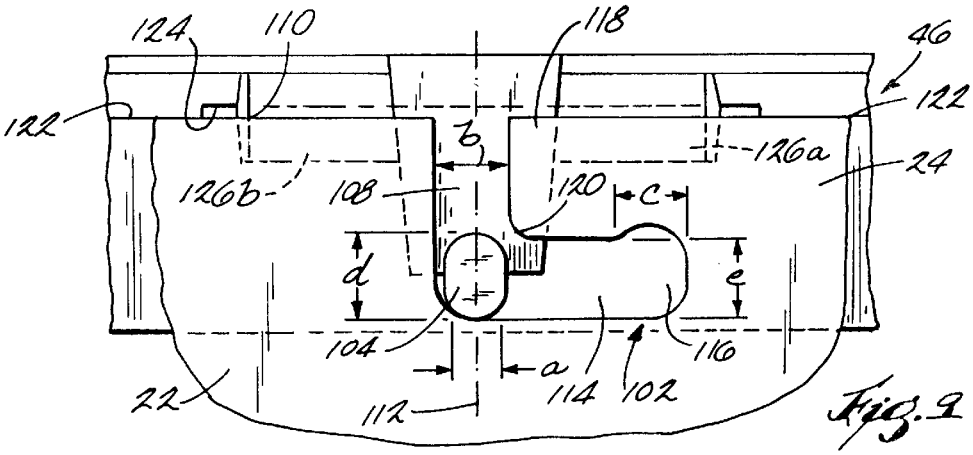
FIGS. 9–11 are enlarged, fragmentary, side elevational views of the housing and mounting showing the position of the lugs on the mounting ring in the slots in the housing during relative movement of the mounting ring and housing between an unlocked position and a locked position.
Figure 10:
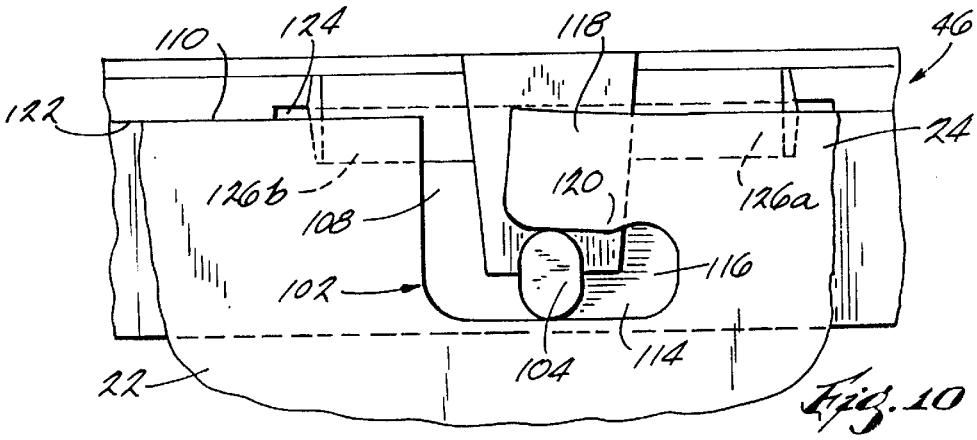
Figure 11:
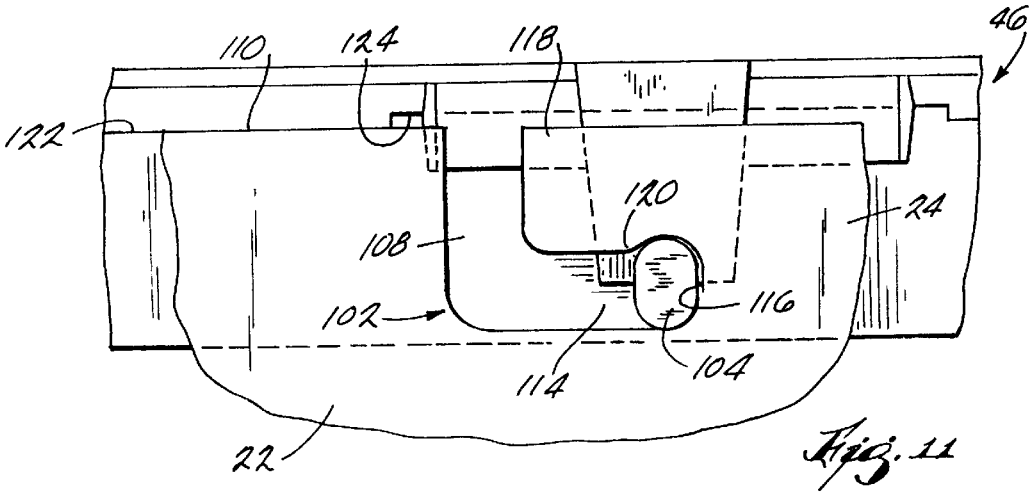

If the mounting ring 46 is to be installed on the housing 22 before mounting on the counter, it is moved downwardly toward the top edge 110 of the housing 22 with the lugs 104 aligned with the first slot leg 108 and downward movement is continued until the lugs 104 bottom out at the juncture of the first and second slot legs 108 and 114 (FIG. 9). The mounting ring 46 is then rotated clockwise relative to the housing 22, as viewed in FIGS. 9–11, until the lugs 104 bottom at the juncture of the second and third slot legs 114 and 116 (FIG. 11).

If the mounting ring 46 is mounted on the counter prior to installation of the housing 22, the housing 22 is mounted on the mounting ring 46 from beneath the counter 44. The discharge end 24 of the housing 22 is moved upwardly toward the mounting ring 46 with the first slot legs 108 aligned with the lugs 104 and pushed upwardly until the lugs 104 bottom out at the juncture of the first and second slot legs 108 and 114. The housing 22 is then rotated clockwise relative to the mounting ring 46, as viewed in FIGS. 9–11, until the lugs 104 bottom out at the juncture of the second and third slot legs 114 and 116.

The mounting ring 46 and the housing 22 are in an unlocked position when the lugs 104 are located in the first slot leg 108 and the mounting ring 46 can be separated from the housing 22 or vice versa. The mounting ring 46 and the housing 22 are in a locked position when the lugs are located in the third leg 116 (FIG. 11) and both relative rotational and longitudinal movement of the mounting ring 46 and the housing 22 are restrained.

The discharge end 24 of the housing 22 includes a tab-like portion 118 associated with each slot 102 and defined in part by the first, a second and third slot legs 108, 114 and 116. As illustrated in FIGS. 9–11, each lug 104 has a width a smaller than the width b of the first slot leg 108 and the width c of the third slot leg 116 and a length d greater than the width e of the second slot leg 114. As illustrated in FIG. 10, since the length d of the lugs 104 is greater than the width e of the second slot leg 114, the tab-like portions 118 are cammed or flexed upwardly (i.e., in a direction toward the top edge 110 of the housing 22) from a normal or unflexed position during relative movement of the mounting ring 46 and the housing 22 between the unlocked and locked positions.

As the lugs 104 are moved into the third slot leg 116, the tab-like portions 118 start to return to their normal or unflexed position and fully return to that position when the lugs 104 reach the third slot legs 116 as illustrated in FIG. 11. The lugs 104 then are in this locked position and relative rotational and longitudinal movement of the mounting ring 46 and the housing 22 is restrained. When the mounting ring 46 is rotated relative to the housing 22 or vice versa, from the locked toward the unlocked position, with a sufficient relative longitudinal movement to bottom the lugs 104 at the juncture of the second and third slot legs 114 and 116, the lugs 104 engage a rounded corner 120 on the tab-like portion 118 and cam the tab-like portion 118 to the flexed position as the lugs 104 are moved through the second slot leg 114 toward the first slot leg 108.

The mounting ring 46 has a circumferentially extending ledge 122 which projects radially inwardly from the inner surface 106 of the mounting ring 46 and extends over and usually engages the top edge 110 of the housing 22 when mounted thereon. The ledge 122 includes a plurality of circumferentially extending recesses 124 located above each housing tab-like portion 118 when the lugs 104 are located in the first slot leg 108. The recesses 124 are dimensioned to receive the tab-like portions 118 as they are moved to a flexed position during relative movement of the mounting ring 46 and the housing 22 between the unlocked and locked positions.

The housing 22 preferably is made from a synthetic thermoplastic material, such as a high density polypropylene, or a synthetic thermosetting material for cost considerations. Fabrication costs usually can be minimized by extruding a synthetic thermoplastic into elongated tubes, cutting the tubes into sections of the desired length for the housing and then cutting the slots 102 in one end. Extruded tubing typically includes internal stresses created by the extruding operation. These stresses can be relieved when the slots 102 are cut, causing the discharge end 24 of the housing 22 to assume an out of round shape. In accordance with a preferred embodiment, the mounting ring 46 is provided with means for forcing the discharge end 24 of the housing 22 back into its normal round or circular shape during assembly of the mounting ring 46 and the housing.

In the specific construction illustrated, such means includes a plurality of circumferentially spaced, generally L-shaped guide members 126 projecting radially inwardly from the top rim 54 of the mounting ring 46. As best shown in FIG. 2, each guide member 126 has a down turned arm 128 including a terminal end 130 and an inner guide surface 132 tapered radially inwardly in a direction from the terminal end 130 toward the top rim 54 of the mounting ring 46. As the mounting ring 46 is moved toward the housing 22 or vice versa, the guide surfaces 132 engage or are engaged by the top edge 110 of the housing 22 and guide it back into the desired round shape as the lugs 104 are guided into the first slot legs 108.

Figure 4:
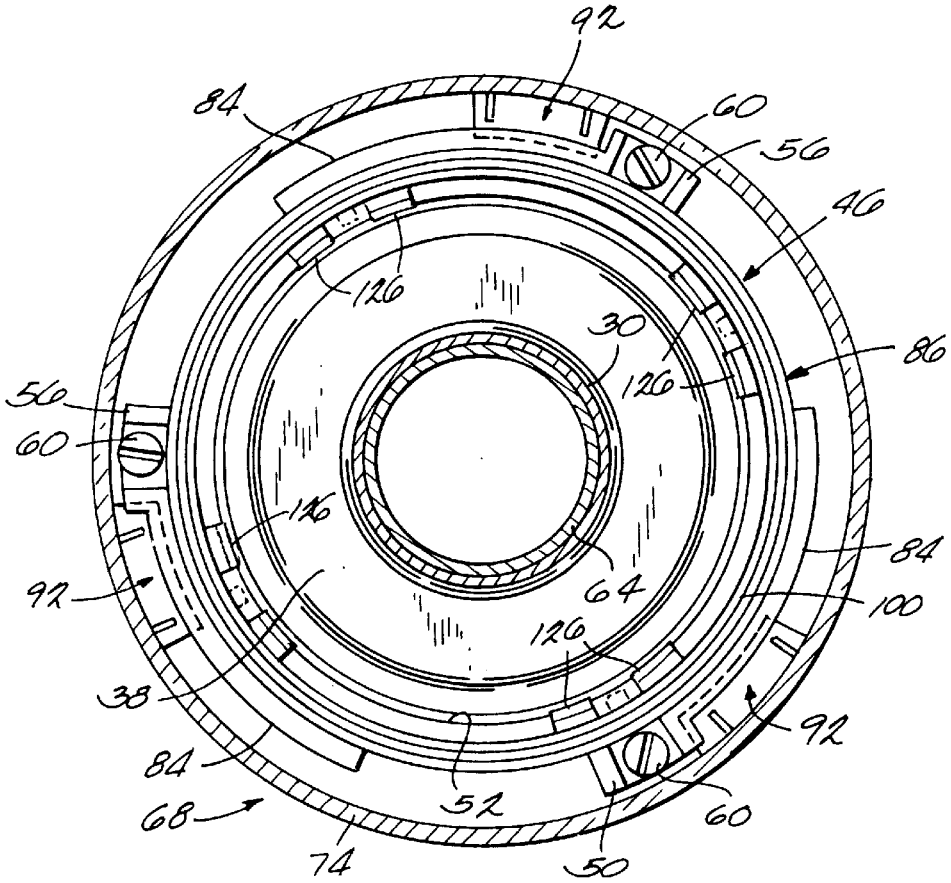
FIG. 4 is a sectional view taken generally along line 4—4 in FIG. 1.

While other suitable numbers of guide members 126 can be used, in the specific construction illustrated, a pair of circumferentially spaced guide members 126 are provided for each lug 104 (FIG. 4). A first or leading guide member **126*a* (FIGS. 9 and 10) first passes over a tab-like portion 118** during relative rotation of the mounting ring 46 and housing 22 and a second or trailing guide member 126*b* is located over a tab-like portion 118 when the mounting ring 46 and housing 22 are in the locked position.

From the forgoing description, one skilled in the art can easily ascertain the essential characteristics of the invention and, without departing from the spirit and scope thereof, make various changes and modifications to adapt it to various usages.

We claim:

1. A cup dispenser comprising an elongated tubular housing for storing a plurality of cups nested in a stack and having an exterior surface, an interior and a discharge end through which cups are dispensed;

an annular collar surrounding the exterior surface of said housing and having an inner surface;

locking means on said collar and said housing cooperating to provide a removable connection between said collar and said housing at a location adjacent the discharge end of said housing and further cooperating to afford relative movement of said collar and said housing between a locked position wherein relative longitudinal and rotational movement of said collar and said housing are restrained and an unlocked position wherein relative movement of said collar and said housing is permitted to separate one from the other, portions of the inner surface of said collar and said locking means exposed to the interior surface of said housing in the vicinity of the discharge end, said collar and said locking means being connected together to eliminate the presence of crevices or cavities which can trap bacteria; and an annular retaining ring carrying a cup holding member and removably mounted on said collar whereby said cup holding member is disposed over the discharge end of said housing to control removal of cups from the stack.

2. A cup dispenser according to claim 1 wherein the discharge end of said housing has an outer edge; and said locking means comprises a plurality of circumferentially spaced lugs extending radially inwardly from the inner surface of said collar, and a plurality of circumferentially spaced generally J-shaped slots in said housing and extending from the outer edge of said housing for receiving said lugs.

3. A cup dispenser according to claim 2 wherein said housing has a longitudinal axis; and each of said slots includes a first portion extending from the outer edge of said housing generally parallel to the longitudinal axis of said housing, a second portion connected to said first portion and extending generally perpendicularly thereto and a third portion connected to said second portion and extending generally perpendicularly thereto and generally parallel to the longitudinal axis of said housing in a direction toward the outer edge of said housing.

4. A cup dispenser according to claim 3 wherein said lugs have a length and width, said first and second slot portions have a width and said third slot portion has a width and height; and the width of said lugs is less than the width of said first and third slot portions, the height of said lugs is greater than the width of said second slot portion and the height of said third slot portion is greater than the width of said second slot portion.

5. A cup dispenser according to claim 4 wherein said housing has tab-like portions defined by the outer edge of said housing and said first, second and third slot portions, said tab-like portions being flexed from a normal position in a direction toward the outer edge of said housing to a flexed position in response to movement of said lug through said second slot portion during relative movement of said collar and said housing from the unlocked position toward the locked position and returning to its normal position when said lug reaches said third slot portion; and said collar includes a circumferentially extending ledge projecting radially inwardly from the inner surface of said collar in the vicinity of each of said slots, said ledge extending over the outer edge of said housing and having a recess in the vicinity of each of said tab-like portions for accommodating movement of said tab-like portions to the flexed position.

6. A cup dispenser according to claim 1 wherein said housing normally has a circular cross section; and said collar includes a plurality of circumferentially spaced guide means for engaging the discharge end of said housing, when the cross section of the discharge end of said housing has an out of round shape, and moving the discharge end of said housing back to its normal round shape during assembly of said collar and said housing.

7. A cup dispenser according to claim 6 wherein the discharge end of said housing has an inner wall; and each of said guide means includes a generally L-shaped guide member having a first leg extending radially inwardly from the inner surface of said collar and a second leg depending from said first leg and having a tapered guide surface which engages the inner wall of said housing and cams the discharge end of said housing radially outwardly toward said collar.

8. A cup dispenser according to claim 7 including a pair of said guide members circumferentially spaced and located on opposite sides of each of said lugs.

9. A cup dispenser comprising an elongated tubular housing for storing a plurality of cups nested in a stack and having an exterior surface, an interior and a discharge end through which cups are dispensed and including an outer edge;

an annular collar surrounding the exterior surface of said housing and having an inner surface;

locking means on said collar and said housing cooperating to provide a removable connection between said collar and said housing at a location adjacent the discharge end of said housing and further cooperating to afford relative movement of said collar and said housing between a locked position wherein relative longitudinal and rotational movement of said collar and said housing are restrained and an unlocked position wherein relative movement of said collar and said housing is permitted to separate one from the other, said locking means comprising a plurality of circumferentially spaced lugs extending radially inwardly from the inner surface of said collar, and a plurality of circumferentially spaced generally J-shaped slots in said housing and extending from the outer edge of said housing for receiving said lugs, portions of the inner surface of said collar and said locking means exposed to the interior surface of said housing in the vicinity of the discharge end, said collar and said locking means being connected together to eliminate the presence of crevices or cavities which can trap bacteria; and an annular retaining ring carrying a cup holding member and removably mounted on said collar whereby said cup holding member is disposed over the discharge end of said housing to control removal of cups from the stack.

10. A cup dispenser according to claim 9 wherein said housing has a longitudinal axis;

each of said slots includes a first portion extending from the outer edge of said housing generally parallel to the longitudinal axis of said housing, a second portion connected to said first portion and extending generally perpendicularly thereto and a third portion connected to said second portion and extending generally perpendicularly thereto and generally parallel to the longitudinal axis of said housing in a direction toward the outer edge of said housing; and said lugs have a length and width, said first and second slot portions have a width and said third slot portion has a width and height; and the width of said lugs is less than the width of said first and third slot portions, the height of said lugs is greater than the width of said second slot portion and the height of said third slot portion is greater than the width of said second slot portion.

11. A cup dispenser according to claim 10 wherein said housing has tab-like portions defined by outer edge of said housing, said first, second and third slot portions, said tab portions being flexed from a normal position in a direction toward the outer edge of said housing to a flexed position in response to movement of said lug through said second slot portion during relative movement of said collar and said housing from the unlocked position toward the locked position and returning to its normal position when said lug reaches said third slot portion; and said collar includes a circumferentially extending ledge projecting radially inwardly from the inner surface of said collar in the vicinity of each of said slots, said ledge extending over the outer edge of said housing and having a recess in the vicinity of each of said tab portions for accommodating movement of said tab portions to the flexed position.

12. A cup dispenser according to claim 11 wherein said housing normally has a circular cross section; and said collar includes a plurality of circumferentially spaced guide means for engaging the discharge end of said housing, when the cross section of the discharge end of said housing has an out of round shape, and moving the discharge end of said housing back to its normal round shape during assembly of said collar and said housing.

13. A cup dispenser according to claim 12 wherein the discharge end of said housing has an inner wall; and each of said guide means includes a generally L-shaped guide member having a first leg extending radially inwardly from the inner surface of said collar and a second leg depending from said first leg and having a tapered guide surface which engages the inner wall of said housing and cams the discharge end of said housing radially outwardly toward said collar.

14. A cup dispenser according to claim 13 including a pair of said guide members circumferentially spaced and located on opposite sides of each of said lugs.

* * * * *